US006464345B2

(12) United States Patent
Kubota et al.

(10) Patent No.: US 6,464,345 B2
(45) Date of Patent: Oct. 15, 2002

(54) LIQUID DISCHARGING HEAD, APPARATUS AND METHOD EMPLOYING CONTROLLED BUBBLE GROWTH, AND METHOD OF MANUFACTURING THE HEAD

(75) Inventors: Masahiko Kubota, Tokyo; Masanori Takenouchi, Yokohama; Kiyomitsu Kudo, Kawasaki; Ryoji Inoue, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/778,725

(22) Filed: Feb. 8, 2001

(65) Prior Publication Data

US 2001/0020966 A1 Sep. 13, 2001

(30) Foreign Application Priority Data

Feb. 15, 2000 (JP) ..... 2000-037188

(51) Int. Cl.[7] ..... B41J 2/05; B41J 2/17

(52) U.S. Cl. ..... 347/65; 347/94

(58) Field of Search ..... 347/20, 54, 61, 347/56, 63, 65, 67, 94; 29/890.1

(56) References Cited

U.S. PATENT DOCUMENTS

| | | | | |
|---|---|---|---|---|
| 4,412,224 | A | 10/1983 | Sugitani | 347/65 |
| 4,417,251 | A | 11/1983 | Sugitani | 347/65 |
| 4,437,100 | A | 3/1984 | Sugitani et al. | 347/65 |
| 4,450,455 | A | 5/1984 | Sugitani et al. | 347/45 |
| 4,480,259 | A | 10/1984 | Kruger et al. | 347/63 |
| 4,496,960 | A | 1/1985 | Fischbeck | 347/68 |
| 4,509,063 | A | 4/1985 | Sugitani et al. | 347/65 |
| 4,521,787 | A | 6/1985 | Yokota et al. | 347/65 |
| 4,558,333 | A | 12/1985 | Sugitani et al. | 347/65 |
| 4,568,953 | A | 2/1986 | Aoki et al. | 347/65 |
| 4,609,427 | A | 9/1986 | Inamoto et al. | 216/27 |
| 4,611,219 | A | 9/1986 | Sugitani et al. | 347/40 |
| 4,646,110 | A | 2/1987 | Ikeda et al. | 347/15 |

(List continued on next page.)

FOREIGN PATENT DOCUMENTS

| | | | |
|---|---|---|---|
| EP | 0160463 | 11/1985 | B41J/3/04 |
| EP | 0 436 047 | 7/1991 | B41J/2/055 |
| EP | 0 443 798 | 8/1991 | B41J/2/14 |
| EP | 0 811 491 | 12/1997 | B41J/2/05 |
| JP | 55-81172 | 6/1980 | B41J/3/05 |
| JP | 61-69467 | 4/1986 | B41J/3/04 |
| JP | 61-110557 | 5/1986 | B41J/3/04 |
| JP | 62-156969 | 7/1987 | B41J/3/04 |
| JP | 63-197652 | 8/1988 | B41J/3/04 |
| JP | 63-199972 | 8/1988 | F16K/15/14 |
| JP | 3-81155 | 4/1991 | B41J/2/05 |
| JP | 04-118248 | 4/1992 | B41J/2/05 |
| JP | 5-124189 | 5/1993 | B41J/2/05 |
| JP | 05-229122 | 9/1993 | B41J/2/05 |
| JP | 6-87214 | 3/1994 | B41J/2/05 |
| JP | 63-28654 | 2/1998 | B41J/3/04 |

OTHER PUBLICATIONS

Patent Abstracts of Japan, vol. 12, No. 478, Dec. 14, 1988, JP 63 199972 A (Aug. 18, 1998).

Patent Abstracts of Japan, vol. 14, No. 331, Jul. 17, 1990, JP 02 113950 A (Apr. 26, 1990).

*Primary Examiner*—John Barlow
*Assistant Examiner*—Juanita Stephens
(74) *Attorney, Agent, or Firm*—Fitzpatrick, Cella, Harper & Scinto

(57) ABSTRACT

A liquid discharging head includes a discharge port and a liquid passage provided with bubble-generating means and a movable member. The liquid passage has one side which is closed, and one side which communicates with the discharge port and with a liquid supply port. The movable member has a free end on the closed side of the liquid passage and a fulcrum on the other side. The bubble-generating means is disposed on a wall of the liquid passage facing the free end of the movable member and facing a wall in which the liquid supply port is provided. The movable member is separated from the discharge port by a gap in the liquid passage corresponding to the bubble-generating means. The projected area of the movable member on the liquid supply port is larger than the opening area of the liquid supply port.

17 Claims, 12 Drawing Sheets

U.S. PATENT DOCUMENTS

| | | | | |
|---|---|---|---|---|
| 4,666,823 | A | 5/1987 | Yokota et al. | 347/65 |
| 4,723,129 | A | 2/1988 | Endo et al. | 347/56 |
| 4,994,825 | A | 2/1991 | Saito et al. | 347/63 |
| 5,095,321 | A | 3/1992 | Saito et al. | 347/63 |
| 5,208,604 | A | 5/1993 | Watanabe et al. | 347/47 |
| 5,262,802 | A | 11/1993 | Karita et al. | 347/87 |
| 5,278,585 | A | 1/1994 | Karz et al. | 347/65 |
| 5,389,957 | A | 2/1995 | Kimura et al. | 347/20 |
| 5,485,184 | A | 1/1996 | Nakagomi et al. | 347/63 |
| 5,821,962 | A | 10/1998 | Kudo et al. | 347/65 |
| 5,940,957 | A | 8/1999 | Goto et al. | 29/611 |
| 5,943,074 | A | 8/1999 | Kashino et al. | 347/54 |
| 6,007,187 | A | * 12/1999 | Kashino et al. | 347/65 |
| 6,048,058 | A | 4/2000 | Kasamoto et al. | 347/94 |
| 6,062,680 | A | 5/2000 | Yoshihira et al. | 347/65 |
| 6,074,543 | A | 6/2000 | Yoshihira et al. | 205/75 |
| 6,095,640 | A | 8/2000 | Ishinaga et al. | 347/65 |
| 6,102,529 | A | 8/2000 | Okazaki et al. | 347/65 |
| 6,109,734 | A | 8/2000 | Kashino et al. | 347/65 |
| 6,113,224 | A | 9/2000 | Sugama et al. | 347/65 |
| 6,154,237 | A | 11/2000 | Kushino et al. | 347/48 |
| 6,155,677 | A | 12/2000 | Kitani et al. | 347/65 |
| 6,196,667 | B1 | 3/2001 | Hiroki et al. | 347/65 |
| 6,206,508 | B1 | 3/2001 | Asakawa et al. | 347/65 |
| 6,270,199 | B1 | 8/2001 | Kimura et al. | 347/65 |
| 6,312,111 | B1 | 11/2001 | Kimura et al. | 347/65 |
| 6,331,050 | B1 | 12/2001 | Nakata et al. | 347/65 |
| 6,334,669 | B1 | 1/2002 | Kudo et al. | 347/65 |

* cited by examiner

LIQUID DISCHARGING HEAD, APPARATUS AND METHOD EMPLOYING CONTROLLED BUBBLE GROWTH, AND METHOD OF MANUFACTURING THE HEAD

BACKGROUND OF THE INVENTION

1. Field of the Invention

The present invention relates to a liquid discharging head, which discharges the liquid by acting a thermal energy on the liquid to generate bubbles, a method of producing the same, and liquid discharging apparatus which uses the same head.

The present invention is applicable to devices, e.g., a printer and copier recording images on a printing medium (e.g., paper, yarn, fiber, cloth, leather, metal, plastic, glass, lumber and ceramic), a facsimile having a communication system, a word processor having a printer, and an assembly in which an industrial recording device is combined with a varying processing device.

The term "recording" used herein not only refers to forming a meaning image (e.g., letter, pattern or the like) on a recording medium but also a meaningless image (e.g., pattern).

2. Related Background Art

The ink jet recording method is known for recording devices, e.g., printer. This method, also known as bubble jet recording method, gives energy (e.g., heat) to a liquid ink flowing in a flow passage to generate bubbles, rapid volumetric change as a result of which is used to discharge the ink from the discharge port onto a recording medium to form an image thereon. The recording device which is based on the bubble jet recording method generally has an ink discharge port from which the ink is discharged, an ink passage leading to the discharge port, and an electrothermal converter as the energy-generating means needed for discharging the ink in the passage, as disclosed by, e.g., U.S. Pat. No. 4,723,129.

This type of recording method has various advantages, e.g., giving a high-quality image quickly at low noise, and also easily giving a high-resolution recording image and color image by a compact device, because of its head being provided with ink discharge ports at a high density. Therefore, the bubble jet recording method recently has been massively going into various office devices, e.g., printers, copiers and facsimiles, and even into industrial systems, e.g., textile printers.

As the bubble jet techniques are finding wider use in various areas, they are increasingly required to have higher functions, for which various proposals have been made, e.g., driving conditions for improved liquid discharging methods which allow higher ink discharging speed and better ink discharging based on stable bubble generation for higher-quality images, and improved ink flow passage shapes for a liquid discharging head which secures faster refill of the discharged liquid into the passage.

For the head in which the bubbles are generated and grown in the nozzle to discharge the liquid, it is known that growth of the bubbles away from the discharge port and the resultant liquid flow deteriorate discharging energy efficiency and refill characteristics. The structures to improve discharging energy efficiency and refill characteristics are disclosed by European Patent Application Laid-Open Specification EP0436047A1.

The above invention has the first valve between the vicinity of the discharge port and a bubble generating section to completely cut off them from each other, and second valve between the bubble generating section and ink supply section also to completely cut off them from each other, wherein these valves open or close alternately (FIG. 4 to FIG. 9 in EP436047A1 specification). For example, referring to FIG. 14 in this specification, which is FIG. 7 in the EP436047A1 specification, the heat generating member 110 is provided almost at the center of the ink passage 112 running between the ink tank 116 and nozzle 115, the ink tank 116 being on the base plate 125 which forms the inner wall for the ink passage 112. The heat generating member 110 is encased in the totally closed compartment 120 in the ink passage 112. The ink passage 112 is composed of the base plate 125 directly coated with the thin films 123 and 126 placed one on another, and tongue-like pieces 113 and 130 as the closing bodies. The tongue-like piece in the open condition is shown in FIG. 31 by the dotted lines. The thin film 123, running in the plane in parallel to the base plate 125 and terminating at the stopper 124, covers the ink passage 112. As the bubbles are generated in the ink, the free end of the tongue-like piece 130 in the nozzle area, in closely contact with the stopper 126 while it is stationary, moves upward, and the ink liquid in the compartment 120 is ejected from the nozzle 115 via the ink passage 112. In this case, the ink liquid in the compartment 120 is prevented from moving towards the ink layer 116, because the tongue-like piece 113 in the ink layer 116 area comes into close contact with the stopper 124 while it is stationary. The tongue-like piece 130 moves downward, as the bubbles in the ink disappear, and comes into close contact with the stopper 126 again. Then, the tongue-like piece 113 falls in the ink compartment 120, allowing the ink liquid to flow into the compartment 120.

SUMMARY OF THE INVENTION

The invention disclosed in EP0436047A1 has several disadvantages. For example, the ink following the bubbles significantly trails while it is discharged, because two out of the three compartments of near the discharge port, bubble generating section and ink supply section are separated from each other, producing a fairly larger quantity of the satellite dots than the conventional discharging method involving growth, shrinkage and disappear of the bubbles. This trouble conceivably results from loss of the effect of meniscus retreat accompanying disappear of the bubbles. Another disadvantage is dissipation of large quantity of energy for discharging the ink, when the valve on the bubble discharge side is closed. Still other disadvantages are large fluctuation of size of the discharged liquid droplets and extremely low discharge response frequency, which make the invention impractical. These problems come from its structure: the compartment is refilled to make up the ink to be supplied to the nozzle as the bubbles in the liquid disappear in the bubble generating section, and the vicinity of the discharge port cannot be supplied with the liquid until the new bubbles are generated.

The present invention provides an innovative method and head structures which simultaneously satisfy the characteristics running counter to each other; improved efficiency of controlling growth of the bubble component away from the discharge port, and improved refill efficiency and characteristics, based on the new concept. They also satisfy requirements for improved discharging efficiency.

The inventors of the present invention have found, after having extensively studied to satisfy the above requirements, that growth of the bubbles away from the discharge port (i.e., towards the rear side) is controlled by the special check valve function in the straight nozzle structure in the liquid-discharging head, where the liquid is discharged as the bubbles grow, and that the discharging energy towards the rear side can be effectively utilized for the discharge port side. They also have found that controlling growth of the bubble component towards the rear side by the special check valve function can increase discharge response frequency to an extremely high level.

It is an object of the present invention to simultaneously improve discharge power and discharge frequency by the nozzle structure and discharging method incorporating a novel valve function, and thereby to establish the novel discharging formula (structure) for a head which can produce higher-quality images at a higher speed than the conventional one can achieve.

In order to achieve the above objects, the liquid discharging head of the present invention is provided with a discharge port for discharging the liquid, liquid passage provided with bubble-generating means for generating the bubbles in the liquid supplied via a liquid supply port, and in communication with the discharge port at its one end, and movable member arranged apart from the discharge port by a gap in the liquid passage for the bubble-generating means, wherein the projected area of the movable member on the liquid supply port is larger than the opening area of the liquid supply port; the bubble-generating means is arranged on the wall, via the movable member, facing the wall to which the liquid supply port in the liquid passage is open; the movable member is on the one end of the liquid passage as the fulcrum and its free end is arranged on the closed side of the liquid passage; the bubble-generating means is arranged to face the free end of the movable member in the same direction; the liquid supply port is open to the liquid passage on the side of the fulcrum for the movable member; and the discharge port is positioned on the side of the fulcrum for the movable member.

In the above liquid discharging head, the bubbles when generated by the bubble-generating means in the liquid passage produces pressure waves, which displace the free end of the movable member, to substantially close the liquid supply port by the movable member, where the movable member is supported by one end of the liquid passage as the fulcrum, and the discharge port is in communication with the liquid passage in the area of the fulcrum for the movable member. Therefore, volume of the liquid passage little increases even when the movable member is displaced, with the result that most of the pressure waves produced by the bubbles propagate towards the discharge port, to greatly increase discharge power. As a result, good discharge can be secured, even when a viscous liquid is used or the liquid increases in viscosity under the changed environments. The liquid little moves towards the liquid supply port, because of the liquid supply port being substantially closed, thereby controlling retreat of the meniscus at the discharge port which has discharged the liquid. As a result, the meniscus recovers quickly after the liquid is discharged, and discharging (driving) frequency can be drastically increased when the liquid is to be discharged accurately (at a constant rate).

The liquid discharging head of the present invention is provided with a discharge port for discharging the liquid, liquid passage provided with bubble-generating means for generating the bubbles in the liquid supplied via a liquid supply port, and in communication with the discharge port at its one end, and movable member arranged apart from the discharge port in the liquid passage for the bubble-generating means, wherein the projected area of the movable member on the liquid supply port is larger than the opening area of the liquid supply port; the liquid passage is in communication with the discharge port at one end; the movable member is supported by the fulcrum on the side where the bubbles generated by the bubble-generating means greatly grow, and has the free end on the side where growth of the bubbles is controlled; the liquid supply port is open to the liquid passage on the side of the fulcrum for the movable member; and the movable member substantially closes the liquid supply port as the bubbles are generated by the bubble-generating means. The liquid discharging head of this design propagates the pressure waves produced by the bubbles in a concentrated manner towards the discharge port positioned on the side of the fulcrum for the movable member, to discharge the liquid through the discharge port, and displaces the free end of the movable member towards the bubble-generating means side as the bubbles disappear and allows the liquid supply port positioned on the side of the fulcrum for the movable member to come in communication with the liquid passage, to supply the liquid to the liquid passage via the liquid supply port.

In the above liquid discharging head, the bubbles generated by the bubble-generating means produce the pressure waves, which displace the free end of the movable member to substantially close the liquid supply port by the movable member. The bubbles largely grow towards the discharge port side but their growth in the opposite direction is controlled in the liquid passage, with one end in communication with the discharge port and the other end being closed. Since the movable member has the fulcrum on the side where the bubbles largely grow and the free end on the side where growth of the bubbles is controlled as in the case of the liquid discharging head, most of the pressure waves produced by the bubbles is directed towards the discharge port side to drastically increase discharging power. The liquid supply port is substantially closed, and the bubbles on the closed side in the liquid passage, as the bubble-generating area where the bubbles are generated by the bubble-generating means, start to disappear faster than those in the bubble-generating area on the discharge port side, causing the liquid flow from the liquid supply port into the liquid passage, and, at the same time, displacing the movable member towards the bubble-generating area, with the result that the meniscus recovers quickly after the liquid is discharged and, hence, discharging frequency drastically increases.

It is preferable for the liquid discharging head of the present invention to have the discharge port positioned on the side of the fulcrum for the movable member, and the liquid supply port open to the liquid passage also on the side of the fulcrum for the movable member. The movable member substantially closes the liquid supply port side in the liquid passage during the initial stage of bubbling in the bubble-generating area. It is difficult for, e.g., the action of recovering by keeping the discharge port side at a vacuum to easily remove the residual bubbles, when these bubbles produced during the bubbling process remain in the closed space in the liquid passage. On the other hand, the present invention can remove the residual bubbles, because the movable member has the free end at the position where the liquid passage is closed, and the liquid passage is refilled with the liquid from the closed bubble-generating area in the liquid passage via the liquid supply port, as the free end of the movable member is displaced, improving the discharge characteristics of the liquid discharging head and its reliability.

The liquid discharging apparatus of the present invention is provided with the above-described liquid discharging head of the present invention and a carrying means for carrying the recording medium which receives the liquid discharged from the liquid discharging head, to record images on the recording medium with the ink discharged from the liquid discharging head.

The method for discharging liquid of the present invention is a liquid discharging method for the liquid discharging head provided with a discharge port for discharging the liquid, bubble-generating means for generating the bubbles to discharge the liquid from the discharge port, liquid passage whose one end is in communication with the discharge port and the other end is closed, liquid supply port in the liquid passage to supply the liquid to the passage, and movable member arranged apart from the discharge port in the liquid passage side for the bubble-generating means, wherein the projected area of the movable member on the liquid supply port is larger than the opening area of the liquid supply port; the movable member substantially closes the liquid supply port as the bubbles are generated by the bubble-generating means; the bubbles largely grow towards the discharge port side while being controlled to grow towards the closed side of the liquid passage, to discharge the liquid from the discharge port; and the free end of the movable member is displaced towards the bubble-generating means side as the bubbles disappear, and the liquid supply port positioned on the side of the fulcrum for the movable member comes in communication with the liquid passage, to cause flow of the liquid via the liquid supply port from the fulcrum side to the free end side of the movable member on the liquid supply port side of the movable member, and also from the free end side to the fulcrum side of the movable member on the bubble-generating means side of the movable member, to supply the liquid to the liquid passage.

The present invention also provides a method of producing the liquid discharging head, which is provided with a discharge port for discharging the liquid, bubble-generating means for generating the bubbles in the liquid supplied via the liquid supply port, liquid passage in communication with the discharge port, and movable member arranged apart from the supply port in the liquid passage for the bubble-generating area, wherein the projected area of the movable member on the liquid supply port is larger than the opening area of the liquid supply port. This method comprises several steps of forming the first gap-forming member for forming a gap on the first base plate between the liquid supply port and movable member; forming a film of a material which serves as the material for the movable member, which covers the first base plate and first gap-forming member; patterning the above film into a cantilever shape with one end as the fulcrum on the liquid passage side and the other end as the free end; forming the second gap-forming member in the liquid passage on the above film; forming the wall member as the side wall of the liquid passage on the above film and second gap-forming member; flattening the second gap-forming member and side wall in such a way that they form one plane; forming the second base plate containing the bubble-generating means on the flattened second gap-forming member and side wall; forming the discharge port in the section of the second base plate corresponding to one end of the liquid passage; opening the first base plate to form the liquid supply port having a smaller opening area than the projected movable member; and removing the first gap-forming member, and second gap-forming member via the liquid supply and discharge ports.

The above method can produce the liquid discharging head of greatly improved discharging power and frequency, as discussed above.

The other effects of the present invention can be understood, as they are described in the preferred embodiments, described later.

The terms "upstream" and "downstream" described herein are related to a direction of flow of the liquid from the liquid supply source to the discharge port via the bubble-generating area (or movable member), or to such a direction in terms of configuration.

The "downstream side" of the bubbles themselves means those generated downstream of the above flow or configuration direction with respect to the bubble center or area center of the heat generating member.

DESCRIPTION OF THE PREFERRED EMBODIMENTS

Figure 1:
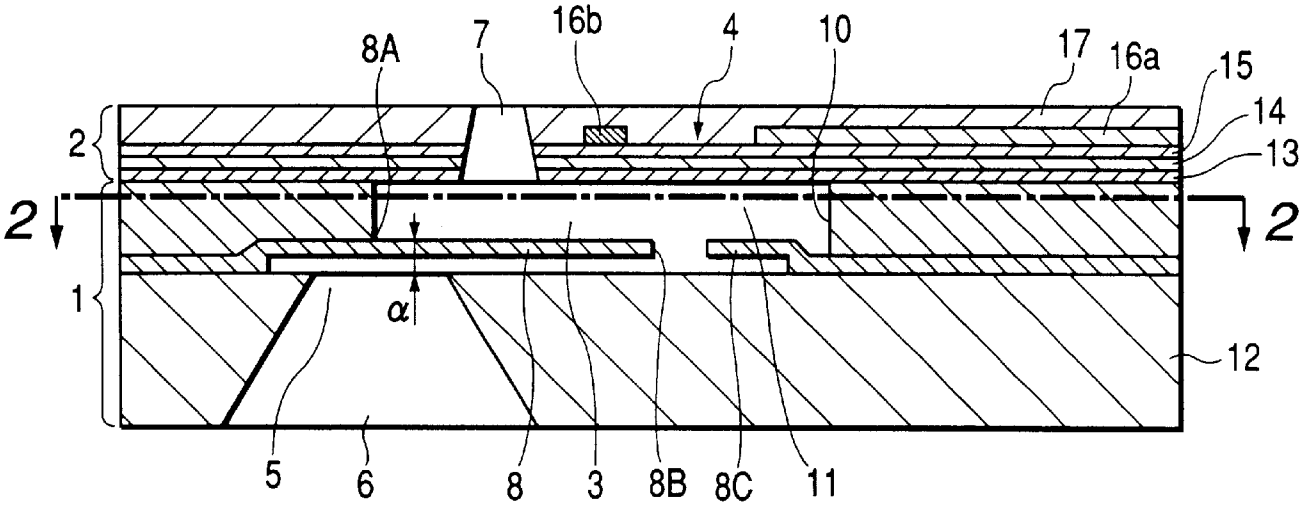
FIG. 1 is a sectional view of the liquid discharging head as one embodiment of the present invention, along the liquid passage in the longitudinal direction.

Next, the preferred embodiments of the present invention are described by referring to the drawings.

Figure 2:
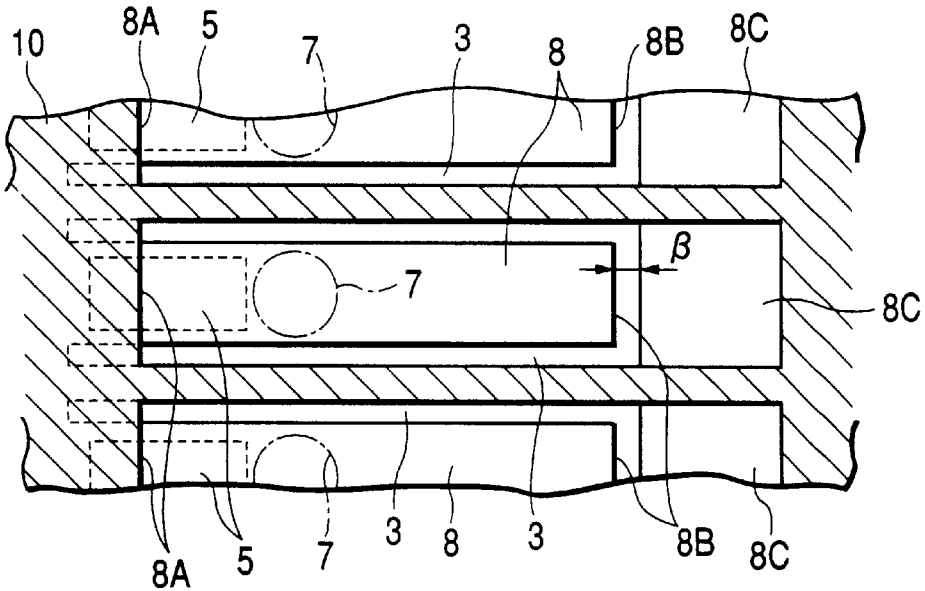
FIG. 2 is the sectional view of the liquid discharging head shown in FIG. 1, cut in the Y–Y' direction.

FIG. 1 is a sectional view of the liquid discharging head as one embodiment of the present invention, along the liquid passage in the longitudinal direction, and FIG. 2 is the sectional view of the liquid discharging head shown in FIG. 1, cut in the Y–Y' direction.

The liquid discharging head of this embodiment has the base plate 1 as the major member of the passage structure, and the top plate 2 which is on the base plate 1 and constitutes the liquid passage 3 together with the base plate 1.

The base plate 1 is composed of the Si substrate 12, movable member 8 formed on the Si substrate 12, and side wall 10 which serves as the side wall for the liquid passage 3. This liquid discharging head has two or more liquid passages 3, each having its own movable member 8. The Si substrate 12 carries the common liquid supply chamber 6 which holds the liquid to be supplied to each of the liquid passages 3. Two or more liquid supply ports 5, each corresponding to each liquid passage 3, are open to the common liquid supply chamber 6, and each liquid passage 3 is in communication with the single common liquid supply chamber 6 via the liquid supply port 5.

The movable member 8 is shaped like a cantilever, covering the liquid supply port 5 while keeping a minute gap $\alpha$ from the Si substrate 12, and formed by part of the thin film over the Si substrate 12. The tongue-shaped piece 8C, formed while the movable member 8 is formed from the above-described thin film, is in the extension of the free end 8B of the movable member 8, in such a way that the free end 8B and tongue-shaped piece 8C face each other. The movable member 8 has minute gaps $\beta$ between the free end 8B and tongue-shaped piece 8C, and also between the both ends continuous to the free end 8B and passage side wall 10.

The liquid supply port 5 is open to the liquid passage 3 on the side of the fulcrum 8A for the movable member 8, wherein the projected area of the movable member 8 on the Si substrate 12 is larger than the opening area of the liquid supply port 5, as shown in FIG. 2. When the movable member 8 is displaced towards the Si substrate 12, at least the free end 8B comes into contact with the Si substrate 12, to substantially close the liquid supply port 5 to the liquid passage 3. The fulcrum 8A for the movable member 8 is the boundary between the passage side wall 10 on the portion of the above-described thin film which constitutes the movable member 8 and liquid passage 3 on the movable member 8.

The top plate 2 is provided on the passage side wall 10 to serve as the upper wall for each liquid passage 3. It is a multi-layered structure having the heat generating member 4 as the bubble-generating means, which heats the liquid in the liquid passage 3 to generate the bubbles, and is composed of the cavitation-resistant film 13, protective film 14 which protects the heat generating member 4 from the liquid, heat-generating resistance layer 15, electrical wiring circuits 16*a* and 16*b* for applying a voltage to the heat-generating resistance layer 15, and SiN film 17 as the uppermost layer of this liquid discharging head, in this order from the bottom. The area between the electrical wiring circuits 16*a* and 16*b* is the heat-generating member 4, and the bubbles are generated in the bubbles generating area 11 heated by the heat-generating member 4 within the liquid passage 3. The heat-generating member 4 is arranged in such a way to face the free end 8B of the movable member 8. The discharge port 7 is formed in the top plate 2 in such a way to be in communication with the liquid passage 3, to discharge the liquid outwards. It is provided on the side of the liquid passage 3 end in the longitudinal direction, opposite to the side the free end 8B of the movable member 8 faces, i.e., on the side of the fulcrum 8A for the movable member 8. In the liquid discharging head of this configuration, the liquid flows from the common liquid supply chamber 6 into the area below the movable member 8 via the liquid supply port 5 towards the free end 8B, at which it turns into the area above the movable member 8 towards the fulcrum 8A for the movable member 8, and is discharged via the discharge port 7. This is the main stream of the liquid from the common liquid supply chamber 6 to the discharge port 7.

Figure 3A:
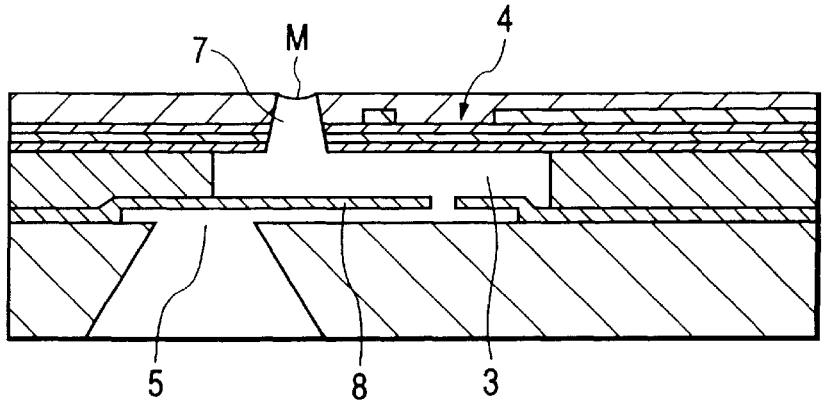
FIGS. 3A, 3B and 3C provide the sections of the liquid discharging head, cut in the liquid flow direction, to explain the discharging actions of the head having the structure shown in FIG. 1 and FIG. 2, where the characteristic phenomena are individually shown.

Next, discharging behavior of the liquid discharging head of the present invention is described in detail. FIGS. 3A to 3C and FIGS. 4D to 4F show the sections of the liquid discharging head, cut in the longitudinal direction of the liquid passage for the liquid discharging head, and also the characteristic phenomena involved, divided into 6 steps, in FIGS. 3A to 3C and in FIGS. 4D to 4F. The portion marked with M in FIGS. 3A to 3C and 4D to 4F are the meniscus formed by the discharged liquid. FIG. 3A shows the condition before energy, e.g., electrical energy, is applied to the heat-generating member 4, i.e., the condition before the heat-generating member 4 generates heat. In this stage, there is a minute gap, 1.0 $\mu$m long or so, between the movable member 8, provided between the liquid supply port 5 and liquid passage 3, and liquid supply port 5.

Figure 3B:
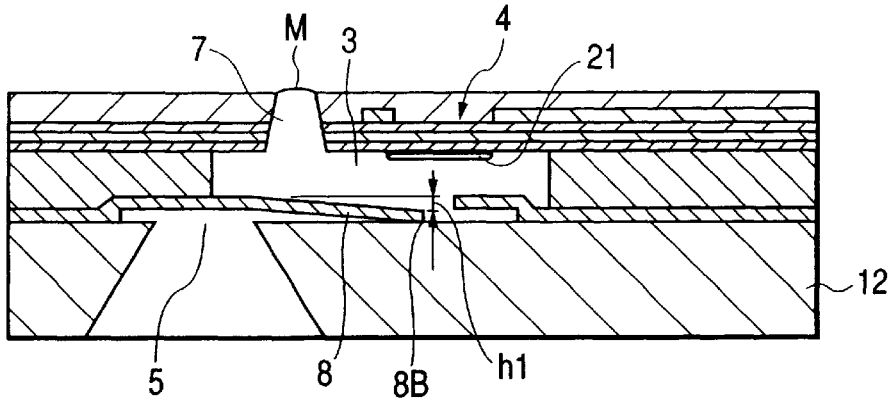

FIG. 3B shows the condition where part of the liquid filling the liquid passage 3 is heated by the heat-generating member 4 to cause film boiling on the heat-generating member 4, and the bubbles 21 grow isotropically. The "isotropic growth of the bubbles" means growth of the bubbles at almost the same rate at each point on the bubble surfaces in the direction perpendicular to the surface. During the initial stage of bubble generation where the bubbles 21 grow isotropically, the free end 8B of the movable member 8 is displaced towards, and comes in closely contact with, the Si substrate 12 to close the liquid supply port 5. As a result, the liquid passage 3 inside is substantially closed, except the discharge port 7 being open. This closed condition lasts for some time during the period of isotropic growth of the bubbles 21. This period may last from start of application of a driving voltage to the heat-generating member 4 to the end of isotropic growth of the bubbles 21. Inertance (resistance of a stationary liquid to any rapid motion) between the center of the heat-generating member 4 and liquid supply port 5 is substantially infinitive in the closed liquid passage 3. During this period, inertance between the center of the heat-generating member 4 and liquid supply port 5 becomes more infinitive as distance between the heat-generating member 4 and movable member 8. The distance h1 is the maximum displacement of the free end 8B of the movable member 8 towards the Si substrate 12.

Figure 3C:
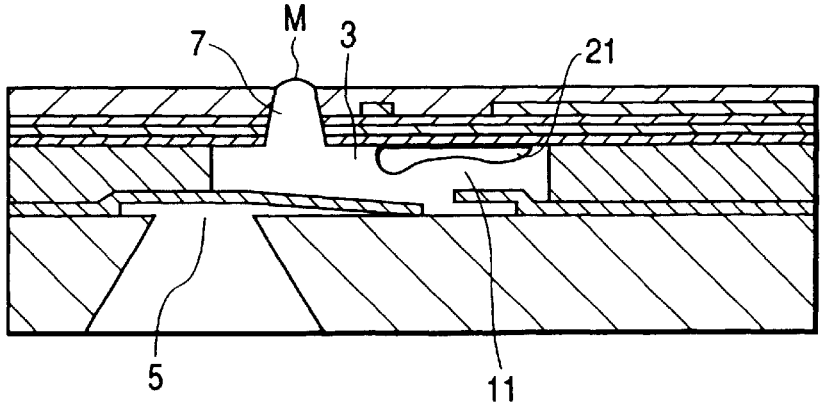

FIG. 3C shows the condition where the bubbles 21 are still growing. Under this condition, the liquid passage 3 inside remains substantially closed except the discharge port 7 being open, as described above, and propagation of the pressure waves to the liquid supply port side 5 resulting from generation of the bubbles 21 is controlled. Therefore, the bubbles 21 grow differently from this stage. More concretely, the bubbles 21 grow greatly towards the side where the discharge port 7 is opened in the liquid passage 3 since the liquid easily moves thereto, whereas grow to only a limited extent to the opposite direction (towards the closed end). As a result, growth of the bubbles 21 continues in the bubble-generating area 11 on the side of the discharge port 7, while stopping in the area on the closed end side. The liquid gains little volume on the side to which the discharge port 7 is open in the liquid passage 3 even when the movable member 8 is displaced, because the movable member 8 is supported by the fulcrum 8A on the side in which the discharge port 7 is open to the liquid passage 3, with the result that the liquid mostly moves towards the discharge port 7. As a result, the pressure waves of the bubbles 21 propagate mostly towards the discharge port 7, to provide power for discharging the liquid via the discharge port 7.

Figure 5A:
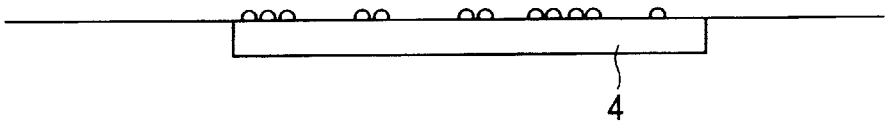
FIGS. 5A, 5B, 5C, 5D and 5E show isotropic growth of the bubbles, shown in FIG. 3B.
Figure 5B:
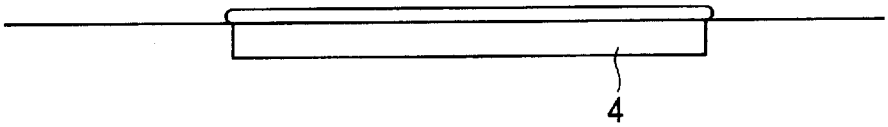
Figure 5C:
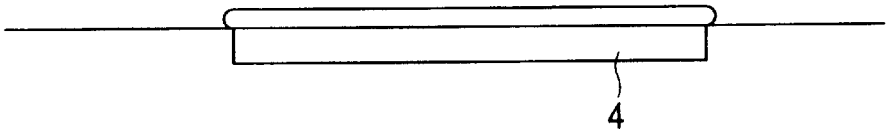
Figure 5D:
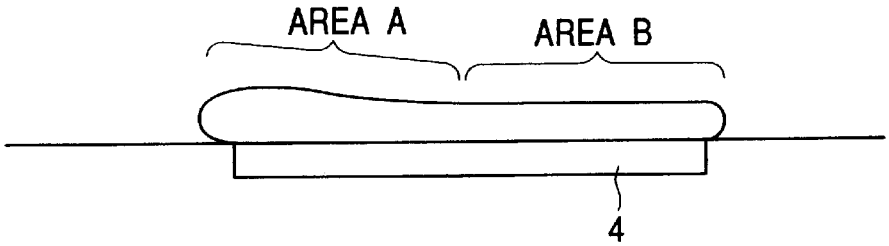
Figure 5E:
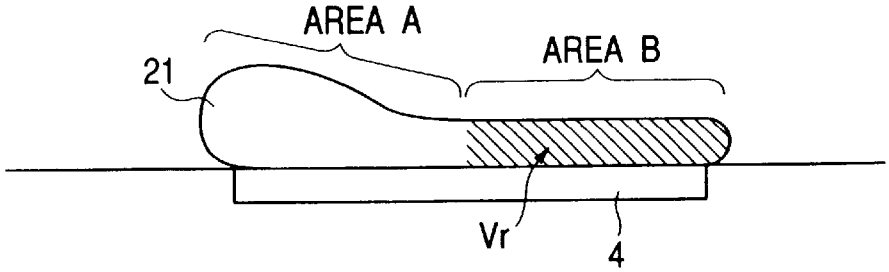

The process in which the bubbles 21 grow, shown in FIGS. 3A to 3C, are described in detail by referring to FIGS. 5A to 5E, which schematically show the heat-generating member 4. Referring to FIG. 5A, random nucleate boiling occurs on the heat-generating member 4 during the initial stage as it is heated, and the boiling mode is later changed to film boiling to cover the heat-generating member 4 with the film-like bubbles, as illustrated in FIG. 5B. The bubbles 21 continue to isotropically grow in the film boiling mode, as illustrated in FIGS. 5B to 5C (the isotropic growth of the bubbles is referred to as semi-pillow condition). When the liquid passage 3 inside is substantially closed except the discharge port 7 being open, as shown in FIG. 3B, the bubbles in the semi-pillow condition can grow to only a limited extent on the upstream side, because of controlled movement of the liquid on the upstream side, with the result that the remaining bubbles on the downstream side (i.e., discharge port 7 side) greatly grow. This is illustrated in FIG. 3C and FIGS. 5D and 5E. For convenience of explanation, the heat-generating member 4 surface is divided into 2 areas, Area A on the discharge port 7 side in which the bubbles grow while the heat-generating member 4 is on, and Area B in which the bubbles little grow.

Figure 4D:
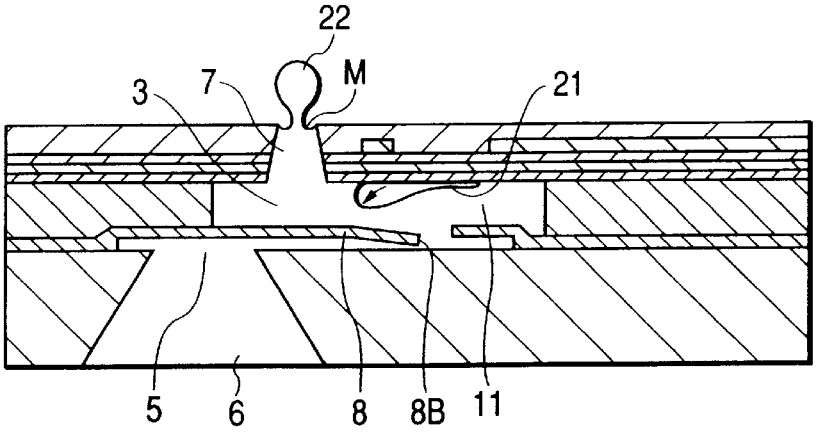
FIGS. 4D, 4E and 4F provide the sections of the liquid discharging head, cut in the liquid flow direction, to explain the discharging actions following those shown in FIGS. 3A to 3C.

FIG. 4D shows the condition in which the bubble 21 is still growing in Area A but starts to shrink in Area B, where the bubble 21 greatly grows towards the discharge port 7 in Area A, discharging the droplet 22 from the discharge port 7. On the other hand, the bubble 21 starts to disappear on the side of the free end 8B of the movable member 8 (in Area B) in the bubble-generating area 11, pulling the liquid from the common liquid supply chamber 6 into the liquid passage 3 via the liquid supply port 5. This displaces the free end 8B of the movable member 8 towards the bubble-generating area 11, making the common liquid supply chamber 6 and liquid passage 3 in communication with each other.

Figure 4E:
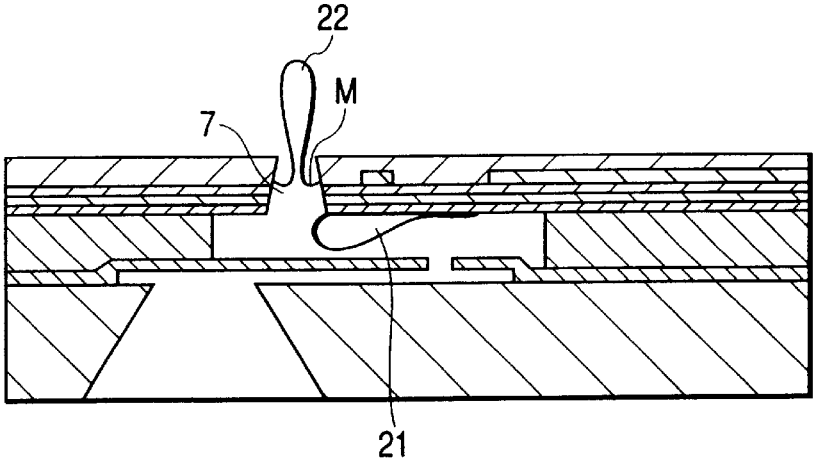

FIG. 4E shows the condition in which the bubble 21 grows almost to the maximum extent in Area A, while almost disappears in Area B. The droplet 22 being discharged from the discharge port 7 trails on, still connected to the meniscus M.

Figure 4F:
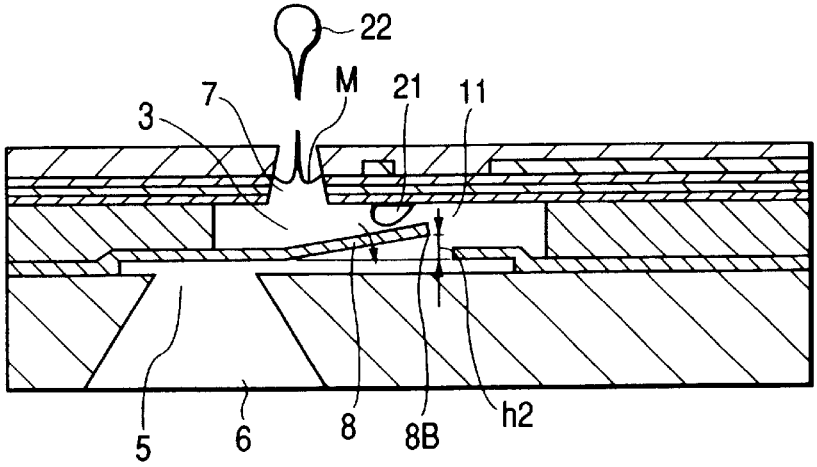

FIG. 4F shows the condition in which the bubble 21 already stops growing and only disappears, and the droplet 22 and the meniscus M are separated from each other. The energy associated with shrinkage of the bubble immediately after the bubble stops growing and starts disappearing in Area A works as a whole to move the liquid in the vicinity of the discharge port 7 upstream. Therefore, the meniscus M is drawn in this stage from the discharge port 7 into the liquid passage 3, to quickly separate the liquid column from the droplet 22 being discharged by a strong force. At the same time, shrinkage of the bubble 21 rapidly induces a massive flow of the liquid from the common liquid supply chamber 6 into the liquid passage 3 via the liquid supply port 5. This sharply diminishes rapid flow of the meniscus M into the liquid passage 3, and moves it back to the initial position in a short time, thus reducing retreat volume of the meniscus M from that of the meniscus produced by the liquid discharging head which lacks the movable member 8 for the present invention, and rapidly converging vibration of the meniscus M. The distance h2 is the maximum displacement of the free end 8B of the movable member 8 towards the bubble-generating area 11.

Finally, as the bubble 21 completely disappears, the movable 8 returns back to the normal position shown in FIG. 3A, and the meniscus M already recovers in the vicinity of the discharge port 7.

Figure 6:
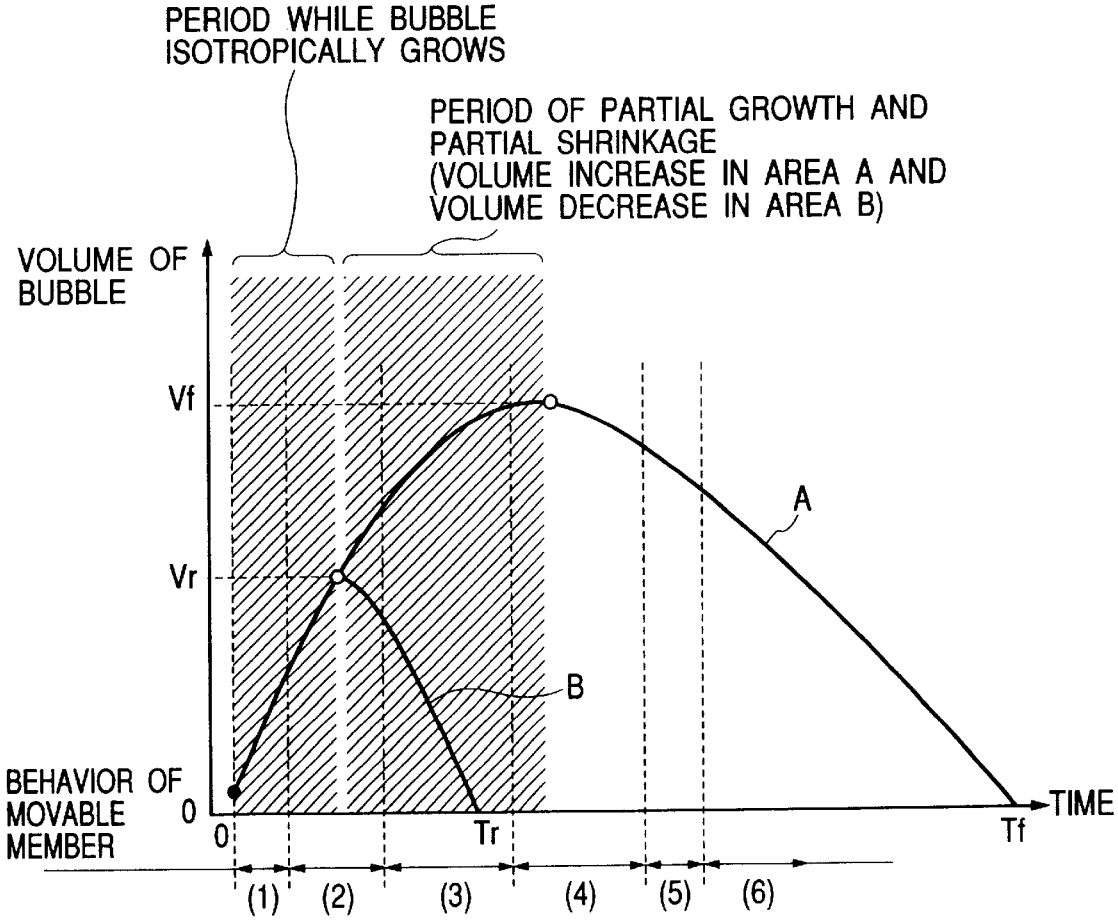
FIG. 6 is a graph showing the relationship between behavior of the movable member and time in Areas A and B, shown in FIGS. 2 and 3A to 3C.

FIG. 6 is a graph showing the relationship between behavior of the movable member and time for which the bubbles change in volume in Areas A and B, shown in FIGS. 3A to 3C and FIGS. 4D to 4F, where Curves A and B are for volumetric change of the bubbles in Areas A and B with time, respectively. This relationship is explained below.

As shown in FIG. 6, Curve A is parabolic with a maximum. In other words, life of the bubble generated in Area A is represented by its volume increasing with time to attain a maximum and then decreasing thereafter. The bubble generated in Area B, on the other hand, is much different from that generated in Area A, the former being shorter in life, smaller in maximum volume, and shorter in time to attain the maximum volume. That is, the time between generation and disappearance of the bubbles and the growth volumetric change of the bubbles are considerably different between Areas A and B, and both of the values are lower in Area B.

It is noted that Curves A and B overlap each other during the initial stage, for which they grow at a similar rate, i.e., isotropically and in a semi-pillow condition, as shown in FIG. 6. Subsequently, Curve B is separated from Curve A at a certain time, at which the bubble generated in Area B starts to disappear while the one generated in Area A is still growing on. There is a period in which the bubble generated in Area A is growing on whereas the one generated in Area B is disappearing (partially growing and partially shrinking period).

The movable member 8 shows the following behavior, in accordance with the bubble growth mode described above, when the heat-generating member 4 is partially covered by the free end 8B of the movable member 8. During the period (1) shown in FIG. 6, the movable member 8 is displaced downward and towards the liquid supply port 5. During the period (2), the movable member 8 comes into close contact with the Si substrate 12, making the liquid passage 3 inside substantially closed, except the discharge port 7 left open. This closed condition starts while the bubble is isotropically growing. During the period (3), the movable member 8 is being displaced upwards to the normal position. The liquid supply port 5 starts opening, driven by the movable member 8, a certain time period after the start of the partially growing and partially shrinking period. During the period (4), the movable member 8 is further displaced upwards from the normal position. During the period (5), upward displacement of the movable member 8 almost stops, producing an equilibrium condition for the movable member 8 at the open position. Finally during the period (6), the movable member 8 is being displaced downwards to the normal position.

As shown in FIG. 6, the relationship Vf>Vr always holds in the liquid discharging head of the present invention, wherein Vf is the maximum volume of the bubble growing on the discharge port 7 side in the bubble-generating area 11, i.e., the bubble formed in Area A, and Vr is the maximum volume of the bubble growing on the liquid supply port 5 side in the bubble-generating area 11, i.e., the bubble formed in Area B. At the same time, the relationship Tf>Tr also always holds in the liquid discharging head of the present invention, wherein Tf is the life time of the bubble (time span from generation to disappearance of the bubble) growing on the discharge port 7 side in the bubble-generating area 11, i.e., the bubble formed in Area A, and Tr is the life time of the bubble growing on the liquid supply port 5 side in the bubble-generating area 11, i.e., the bubble formed in Area B. These relationships mean that the point at which the bubble disappears is positioned to the discharge port 7 side from around the center of the bubble-generating area 11.

The relationship h1<h2 also always holds in the head structure of this embodiment, as shown in FIG. 3B and FIG. 4F, wherein hi is the maximum displacement of the free end 8B of the movable member 8 towards the liquid supply port 5 side during the initial stage of generation of the bubble 21, and h2 is the maximum displacement of the free end 8B of the movable member 8 towards the discharge port 7 side as the bubble 21 disappears. For example, h1 is 1 μm when h2 is 10 μm. This relationship means that growth of the bubble 21 is controlled towards the rear side of the heat-generating member (i.e., opposite to the discharge port 7) during the initial stage of the bubble generation, to further accelerate growth of the bubble towards the front side of the heat-generating member (i.e., towards the discharge port 7). This improves efficiency of converting the bubbling power generated in the heat-generating member 4 into the kinetic energy of the liquid to discharge the droplet from the discharge port 7.

The head structure of this embodiment and its liquid discharging mechanisms, described above, grow the bubble unevenly towards the upstream and downstream sides, the bubble having little component of growing towards the upstream side to control movement of the liquid in this direction. The controlled movement of the liquid towards the upstream side means that the liquid flow is mostly directed towards the discharge port side, while keeping the bubble component growing towards the upstream side, thereby greatly increasing liquid discharging power. Moreover, this reduces retreat volume of the meniscus, thus reducing quantity of the meniscus projecting out of the orifice face during the refilling step by that, and controls vibration of the meniscus, which, in turn, helps stabilize discharge of the liquid over a wide driving frequency from low to high frequency. In other words, the meniscus returns back to the initial condition very quickly after the liquid is discharged, thus drastically improve discharging frequency (driving frequency) for a given quantity of the liquid discharged.

Both the discharge port and liquid supply port are located to the side of the fulcrum for the removable member, and the free end of the movable member is located to the side of the closed end of the liquid passage. This structure allows the liquid to move towards the liquid supply port for refilling as the free end of the movable member is displaced and causes flow of the liquid even in the vicinity of the closed end of the liquid passage, making the residual liquid difficult to remain in the liquid passage for the liquid discharge head.

When an ink is used as the liquid, it is sometimes highly viscous to fix the ink on a recording medium at a high speed and prevent the ink from running in the boundary between the black and another color. The head of the present invention can smoothly discharge such an ink, because of its drastically improved discharging power. The ink may have a thickened area when recording environments change, especially under a low temperature or humidity condition, to an extent that the ink cannot be discharged smoothly during the initial stage. The present invention can smoothly discharge the ink from the very first even under the above conditions. The drastically increased discharging power reduces size of the heat-generating member as the bubble-generating means, and also reduces energy required for discharging the liquid.

Next, one embodiment of the method of producing the liquid discharging head is described by referring to FIGS. 7A to 7F, FIGS. 8G to 8K and FIGS. 9L to 9O.

Figure 7A:
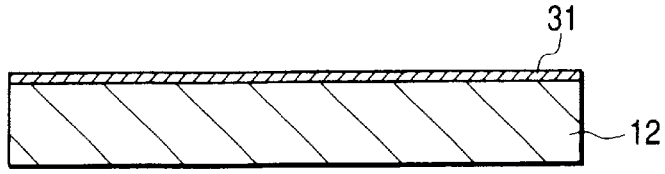
FIGS. 7A, 7B, 7C, 7D, 7E and 7F explain the method of producing the liquid discharging head, shown in FIGS. 1 and 2.

Referring to FIG. 7A, the PSG film 31 is formed by CVD to a thickness of around 1.0 μm on the Si substrate 12, the film 31 constituting the first gap-forming member for forming a minute gap from the movable member 8 (refer to FIG. 1) to be formed in the subsequent step.

Figure 7B:
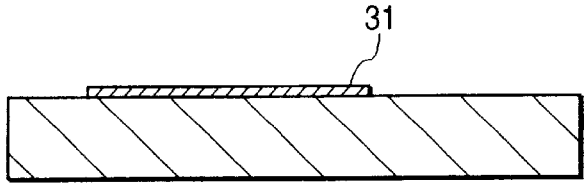

Next, the PSG film 31 is patterned by a known photolithographic process, as shown in FIG. 7B.

Figure 7C:
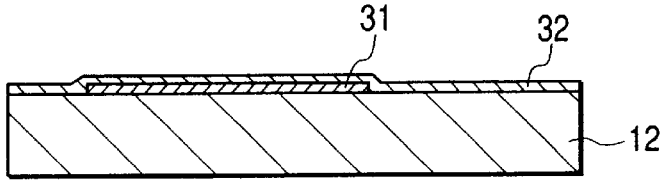
Figure 7D:
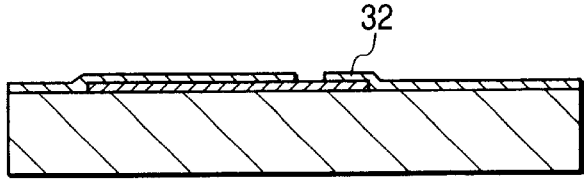
Figure 7E:
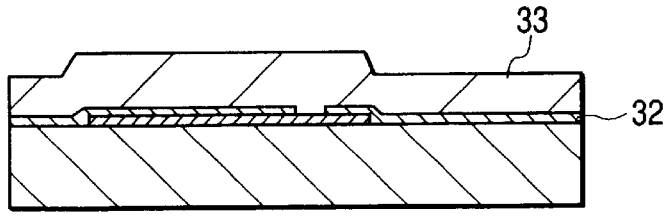

Next, the SiN film 32 is formed by plasma CVD to a thickness of around 3.0 μm on the PSG film 31 and uncoated Si substrate 12, to coat them as shown in FIG. 7C, the film 32 constituting the movable member 8 and joint (support) between the Si substrate 12 and movable member 8. The SiN film 32 is patterned to have the movable member 8 shape by a photolithographic process, as shown in FIG. 7D.

Figure 7F:
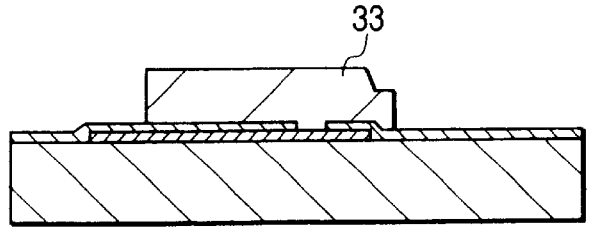

Next, the Al/Cu film 33 is formed as the second gap-forming member by sputtering to a thickness of around 20 μm on the patterned SiN film 32, the film 33 constituting the liquid passage 3 (refer to FIG. 1). It is then patterned to have the liquid passage 3 shape by etching with a mixed solution of acetic, phosphoric and nitric acids, under heating, as shown in FIG. 7F.

Next, the SiN film 34 is formed by plasma CVD to a thickness of around 25 μm to coat the SiN film 32 and Al/Cu film 33. It constitutes the side wall 10 for the liquid passage 3 (refer to FIG. 1).

Figure 8G:
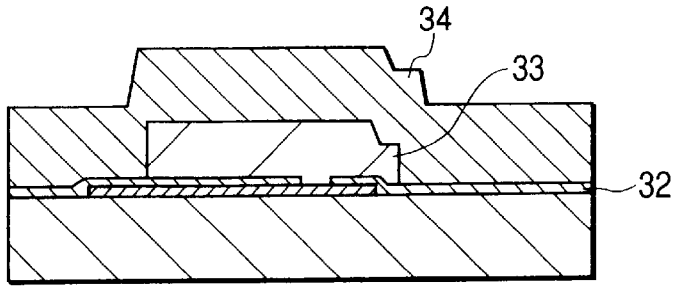
FIGS. 8G, 8H, 8I, 8J and 8K explain the method of producing the liquid discharging head, shown in FIGS. 1 and 2, for the steps following those shown in FIGS. 7A to 7F.
Figure 8H:
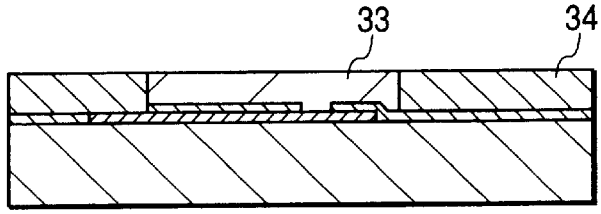

Next, the Al/Cu film 33 and SiN film 34 are ground by the CMP (chemical mechanical polishing) method and flattened to have their surfaces forming the same plane, as shown in FIG. 8H, and to have the alignment pattern (not shown) as the standard for photolithography later conducted.

Figure 8I:
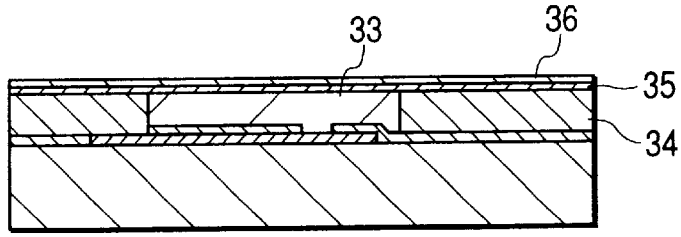

Next, as shown in FIG. 8I the Ta film 35 is formed by sputtering to a thickness of around 2500 Å, and SiN film 36 is formed by plasma CVD to a thickness of around 5000 Å (on the flattened Al/Cu film 33 and SiN film 34,) in this order, the Ta film 35 and SiN film 36 constituting the cavitation-resistant film 13 and protective film 14, respectively (refer to FIG. 1). Then, the flattened Al/Cu film 33 and SiN film 34 are patterned, in this order, by a known photolithographic method into the shapes of the protective film 14 and cavitation-resistant film 13, respectively.

Figure 8J:
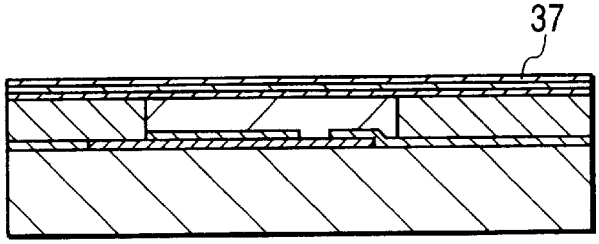
Figure 8K:
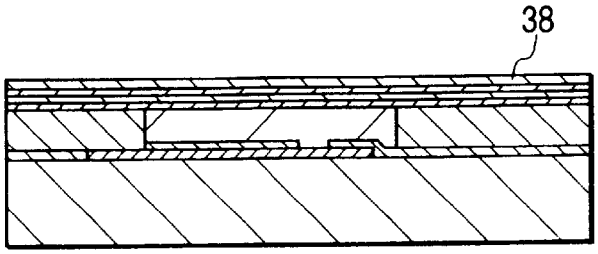
Figure 9L:
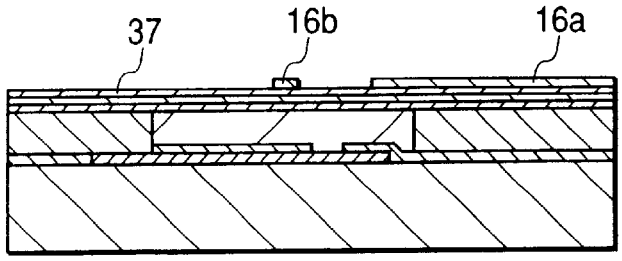
FIGS. 9L, 9M, 9N and 9O explain the method of producing the liquid discharging head, shown in FIGS. 1 and 2, for the steps following those shown in FIGS. 8G to 8K.

Next, the TaSiN film 37 is formed to a thickness of around 500 Å on the SiN film 36 (protective film 14), as shown in FIG. 8J, the TaSiN film 37 constituting the heat-generating resistance layer 15 (refer to FIG. 1), and then the Al film 38 is formed to a thickness of around 5000 Å on the TaSiN film 37, as shown in FIG. 8K. The Al film 38 is patterned by a photolithographic process, to have the electrical wiring circuits 16*a* and 16*b*, as shown in FIG. 9L. Then, the TaSiN film 37 is patterned into the heat-generating resistance layer 15 shape.

Figure 9M:
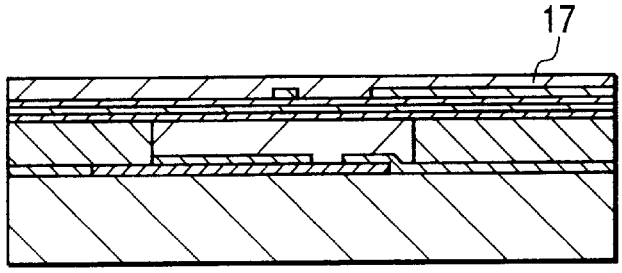

Next, the SiN film 17 is formed by plasma CVD to a thickness of around 5 μm, and flattened/ground by the CMP method, as shown in FIG. 9M. It is the outermost layer for the CMP method.

The SiN film 17 is coated at high temperature with a water-repellent film (not shown) containing fluorine atom. The materials useful for the water-repellent film include fluorine-containing organic compounds, e.g., in particular organic compounds having a fluoroalkyl group and organosilicon compounds having a dimethyl siloxane skeleton.

The fluorine-containing organic compounds preferable for the present invention include fluoroalkyl silanes, and alkanes, carboxylic acids, alcohols and amines having a fluoroalkyl group. More concretely, the fluoroalkyl silanes include heptadecafluoro-1,1,2,2-tetrahydrodecyl trimethoxy silane and heptadecafluoro-1,1,2,2-tetrahydrotrichloro; the alkanes having a fluoroalkyl group include octafluorocyclobutane, perfluoromethylcyclohexane, perfluoro-n-hexane, perfluoro-n-heptane, tetradecafluoro-2-methylpentane, perfluorododecane and perfluoroeicosane; the carboxylic acids having a fluoroalkyl group include perfluorodecanoic acid and perfluorooctanoic acid; the alcohols having a fluoroalkyl group include 3,3,4,4,5,5,5-heptafluoro-2-pentanol; the amines having a fluoroalkyl group include heptadecafluoro-1,1,2,2-tetrahydrodecylamine; and the organosilicon compounds having a dimethyl siloxane skeleton include α, w-bis(3-aminopropyl)polydimethyl siloxane and α, w-bis(vinyl) polydimethyl siloxane.

The outermost layer may be coated with Teflon (Du Pont's registered trade mark) of about 5.0 μm thickness and then fired at high temperature of around 400° C. for treatment to make it water-repellent. It may be also treated with a fluorine plasma.

Figure 9N:
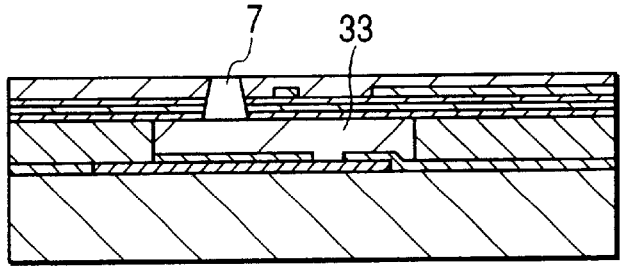

Next, the discharge port 7 is formed by an etching system which uses a dielectrically coupled plasma, as shown in FIG. 9N. The Al/Cu film 33 as the second gap-forming member is used as the etching-stopping layer.

Figure 9O:
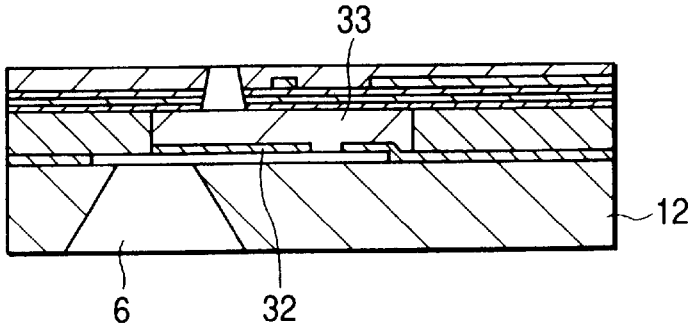

Next, the portion of the Si substrate 12 for the common liquid supply chamber 6 and PSG film 31 as the first gap-forming member are removed by etching with TMAH (tetramethyl ammonium hydride), to form the common liquid supply chamber 6, liquid supply port 5 and gap between the Si substrate 12 and SiN film 32, as shown in FIG. 9O.

Finally, the Al/Cu film 33 as the second gap-forming member is removed by etching under heating with a mixed solution of acetic, phosphoric and nitric acids, via the liquid supply port 5 and discharge port 7.

These steps give the liquid discharging head, shown in FIG. 1, comprising the Si substrate 12 provided with the movable member 8, liquid passage 3, liquid supply port 5 and discharge port 7.

(Other preferred embodiments)

The other preferred embodiments to which the above liquid discharging head is applicable are described below.

<Movable member>

Any material can be used for the movable member in the above embodiment, so long as it is resistant to the discharged liquid and elastic to smoothly work as the movable member.

The materials preferable for the movable member include durable ones, such as metals (e.g., silver, nickel, gold, iron, titanium, aluminum, platinum, tantalum, stainless steel and phosphor bronze, and alloys thereof; resins having a nitrile group (e.g., acrylonitrile, butadiene and styrene), resin having an amide group (e.g., polyamide), resins having a carboxyl group (e.g., polycarbonate), resins having an aldehyde group (e.g., polyacetal), resins having a sulfone group (e.g., polysulfone), liquid-crystal polymers, and their compounds. They also include ink-resistant ones, such as metals (e.g., gold, tungsten, tantalum, nickel, stainless steel, titanium, and alloys thereof), which may be coated to further improve their resistance to ink; resins having an amide group (e.g., polyamide), resins having an aldehyde group (e.g., polyacetal), resins having a ketone group (e.g., polyetheretherketone, resins having an imide group (e.g., polyimide), resins having a hydroxyl group (e.g., phenolic resin), resins having an ethyl group (e.g., polyethylene), resins having an alkyl group (e.g., polypropylene), resins having an epoxy group (e.g., epoxy resin), resins having an amino group (e.g., melamine resin), resins having a methylol group (e.g., xylene resin), and their compounds; and ceramics (e.g., those of silicon dioxide and silicon nitride), and their compounds. The movable member for the present invention has a thickness of the order of micron.

Next, the relative position between the heat-generating and movable members is described. It is possible to adequately control the liquid flow as the bubbles are generated by the heat-generating member and to effectively utilize them by optimally arranging these members.

Figure 10:
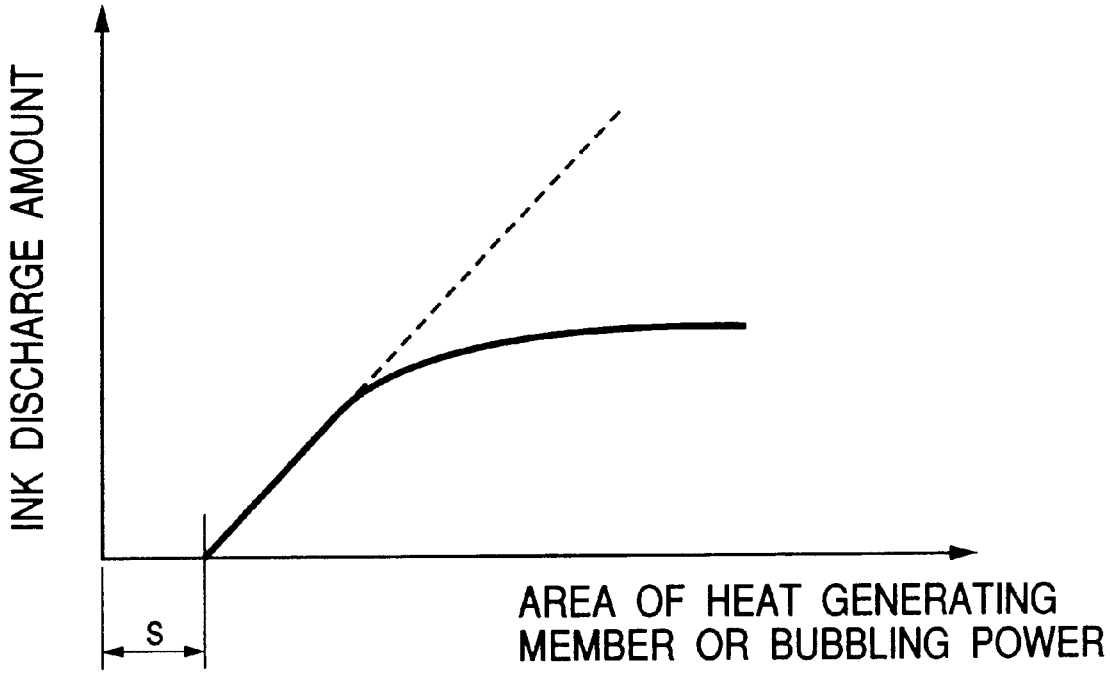
FIG. 10 is a graph showing the relationship between ink discharge amount and surface area of the heat generating member.

The ink jet (or bubble jet) recording method gives energy (e.g., heat) to an ink to cause rapid volumetric change (i.e., generation of the bubbles), and the force produced by this change acts on the liquid to discharge it onto a recording medium and form images thereon. In the conventional techniques for this recording method, the ink discharge amount linearly increases with area of the heat-generating member, following, e.g., a relationship represented by the broken line in FIG. 10. This figure also shows the non-effective bubbling area S which provides no contribution to ink discharge. It is also suggested that these non-effective bubbling areas S are formed in places around the heat-generating area, judging from the scorched conditions on the heat-generating member. It is accepted, based on these observations, that the approximately 4 μm wide width around the heat-generating member has no contribution to the bubbling. By contrast, the liquid discharging head of the present invention has an area of constant discharge amount, as shown by the solid line in FIG. 10, in spite of fluctuations in the heat-generating area or bubbling power, because its liquid passage including the bubble-generating member is substantially closed, except the discharge port being open, to limit the maximum discharge amount. This area of constant discharge amount can be used to stabilize the discharge amount of large dot.

<Heat-generating member>

The above embodiment uses the heat-generating member as the bubble-generating means which includes the heat-generating resistance layer generating heat in accordance with the electric signals it receives. However, the heat-generating member for the present invention is not limited to the above, and any means may be used so long as it can generate a sufficient quantity of bubbles in the liquid to discharge the liquid. Some of the examples include an optothermal converter which generates heat when irradiated with light, e.g., laser beams, and another one which generates heat when irradiated with radiofrequency waves.

The top plate 2 shown in FIG. 1, including the heat-generating resistance layer 15 for the heat-generating member 4 and electrical wiring circuits 16*a* and 16*b* for supplying the electrical signals to the layer 15, may be further incorporated with a functional device, e.g., transistor, diode, latch and shift resistor, to selectively drive the heat-generating member 4 (electrothermal converter) in the semiconductor production line, to form a monolithic assembly.

Figure 11:
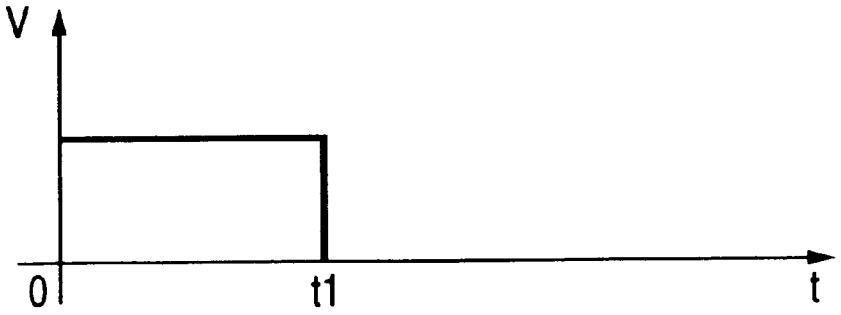
FIG. 11 shows a waveform for driving the heat generating member which is assembled in the liquid discharging head of the present invention.

In order to drive the above heat-generating member 4 and discharge the liquid, rectangular pulses shown in FIG. 11 are applied to the heat-generating resistance layer 15 via the electrical wiring circuits 16*a* and 16*b* to help the layer 15 placed between these circuits 16*a* and 16*b* rapidly generate heat. The liquid discharging head of the above embodiment works, when its heat-generating member is driven by the electrical signals having a voltage of 24 V, pulse width of 7 μsec, amperage of 150 mA and frequency of 6 kHz, to discharge the liquid from the discharge port by the above-described actions. However, the driving signal conditions are not limited to the above, and any signal may be used so long as it can drive the heat-generating member to adequately bubble the liquid.

<Liquid to be discharged>

The liquid to be discharged, when it is an ink for recording (recording liquid), may be the ink of the composition normally used for the bubble-jet recorder.

However, the liquid itself preferably has properties which make the liquid not interfere with discharging, bubbling or movement of the movable member.

A highly viscous ink may be used as the liquid to be discharged for recording.

In the embodiment of the present invention, the dyeing ink of the composition given in Table 1 was used for recording, as the recording liquid which could be discharged by the present invention. It had a viscosity of 2 cP ($2\times10^{-3}$ Pa·s).

TABLE 1

| composition, wt. % | Wt % |
|---|---|
| (C.I. food black) dye | 3 |
| Diethylene glycol | 10 |
| Thiodiglycol | 5 |
| Ethanol | 3 |
| Water | 77 |

The liquid discharging head of the present invention is found to produce very good recording images even with the ink of the above composition, on account of its enhanced discharging power which increases liquid discharge rate and improves droplet flying accuracy.

<Liquid discharging apparatus>

Figure 12:
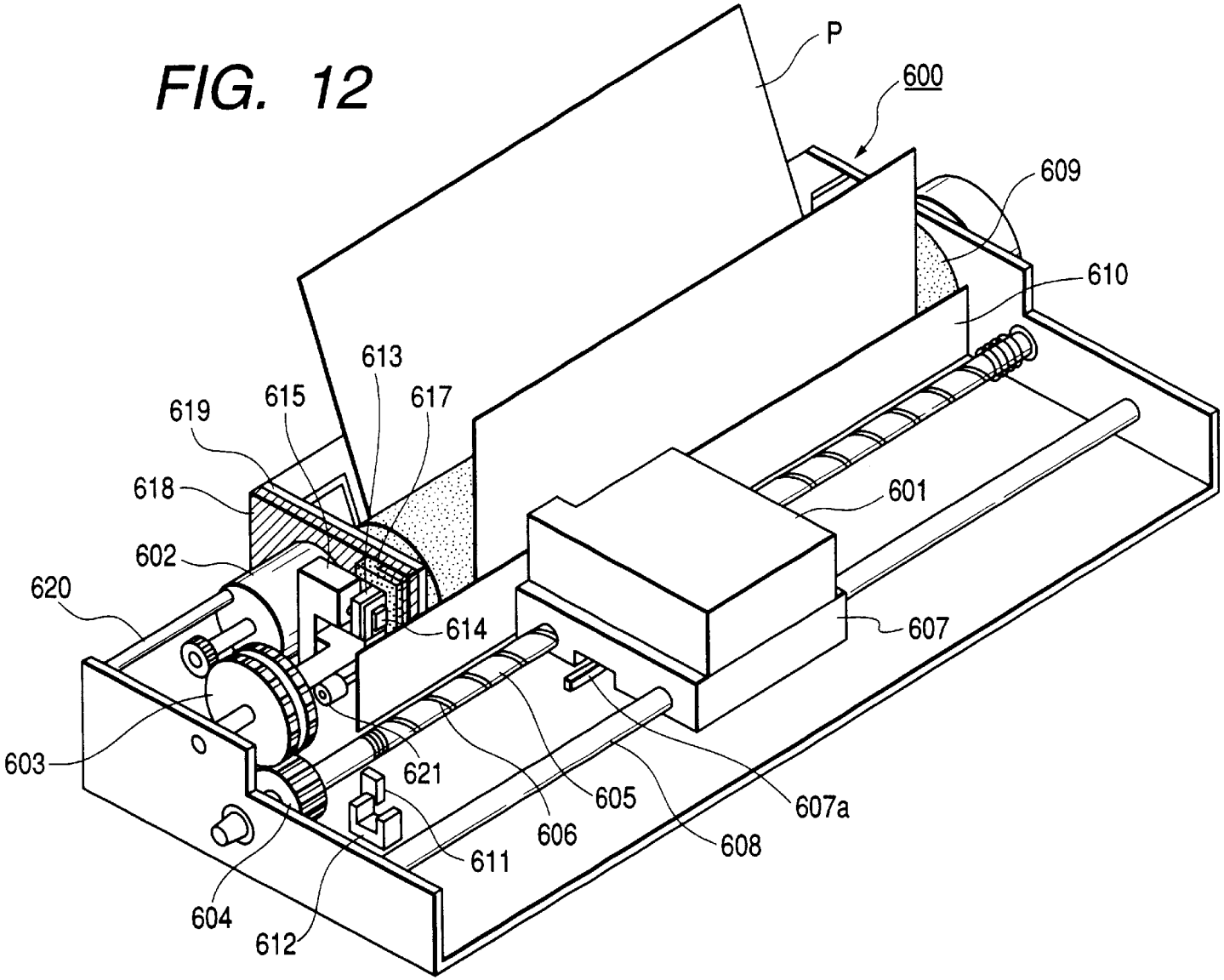
FIG. 12 outlines the structure of the liquid discharging apparatus which carries the liquid discharging head of the present invention.

FIG. 12 outlines the structure of an ink jet recording device as one example to which the liquid discharging head of the structure described by one of the above-described embodiments is applicable. The head cartridge 601 installed in the ink jet recording device 600 shown in FIG. 12 is provided with the liquid discharging head of the above-described structure and liquid container which holds the liquid to be supplied to the liquid discharging head. As shown in FIG. 12 the head cartridge 601 is supported by the carriage 607, fit into the spiral groove 606 for the lead screw 605 which rotates, via the driving force transmitting gears 603 and 604, in phase with the driving motor 602 rotating in the forward and reverse directions. The head cartridge 601 is driven by the driving motor 602 to reciprocate in the directions (a) and (b) along the carriage 607 and guide 608. The ink jet recording device 600 is provided with means (not shown) for transferring the recording medium, which transfers printing paper P as the recording medium onto which the ink is discharged from the head cartridge 601. The plate 610 for holding printing paper P, transferred onto the platen 609 by the means for transferring the recording medium, presses the printing paper P to the platen 609 over the travel of the carriage 607.

The photocouplers 611 and 612 are provided in the vicinity of one end of the lead screw 605. They are means for detecting home position, helping switch rotational direction of the driving motor, after they confirm presence of the lever 607*a* of the carriage 607 in their areas. The support member 613 is provided in the vicinity of one end of the platen 609, to support the capping member 614 which covers the front side (i.e., discharge port side) of the head cartridge 601. The ink withdrawing means 615 is provided to withdraw the ink remaining within the capping member 614, which the head cartridge 601 fails to discharge. The ink withdrawing means 615 recovers the liquid-withdrawing function of the head cartridge 601 via the opening of the capping member 614.

Figure 14:
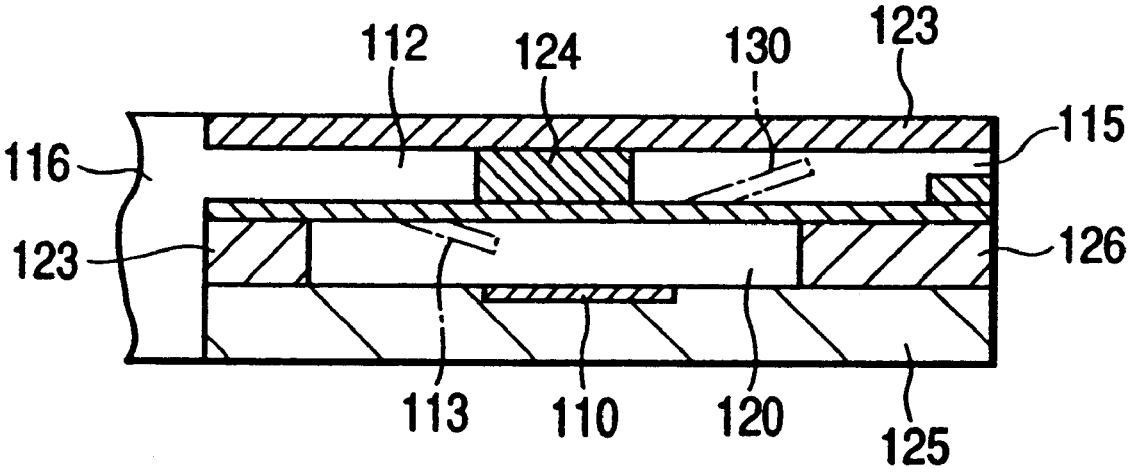
FIG. 14 PRIOR ART
FIG. 14 is a sectional view of the movable member for the conventional liquid discharging head.

The ink jet recording device 600 has the body-supporting member 619, which supports the moving member 618 to help it travel back and forth, i.e., in the direction perpendicular to the carriage 607 motion. The moving member 618 is provided with the cleaning blade 617, the shape of which is not limited to that shown and may be a known one of another type. The ink-withdrawing means 615 has the lever 620 for starting the recovery of ink-withdrawing motion, which moves in phase with the motion of the cam 621 fit into the carriage 607, and is driven and controlled by the driving force from the driving motor 602, transmitted by a known method, e.g., clutch switching. The ink jet recording controller (not shown in FIG. 14) is provided on the recording device body side, to transmit the signal to the heat-generating member in the head cartridge 601 and govern the driving/controlling functions for each mechanism described earlier.

In the ink jet recording device 600 of the above structure, the head cartridge 601 reciprocates over the entire width of printing paper P, transferred by the above-described means for transferring the recording medium onto the platen 609. On receiving the driving signal via the means for supplying the driving signals (not shown) while the head cartridge 601 is reciprocating, the head cartridge 601 triggers the liquid-discharging head to discharge the ink (recording liquid) onto the recording medium for recording, in accordance with the signal.

Figure 13:
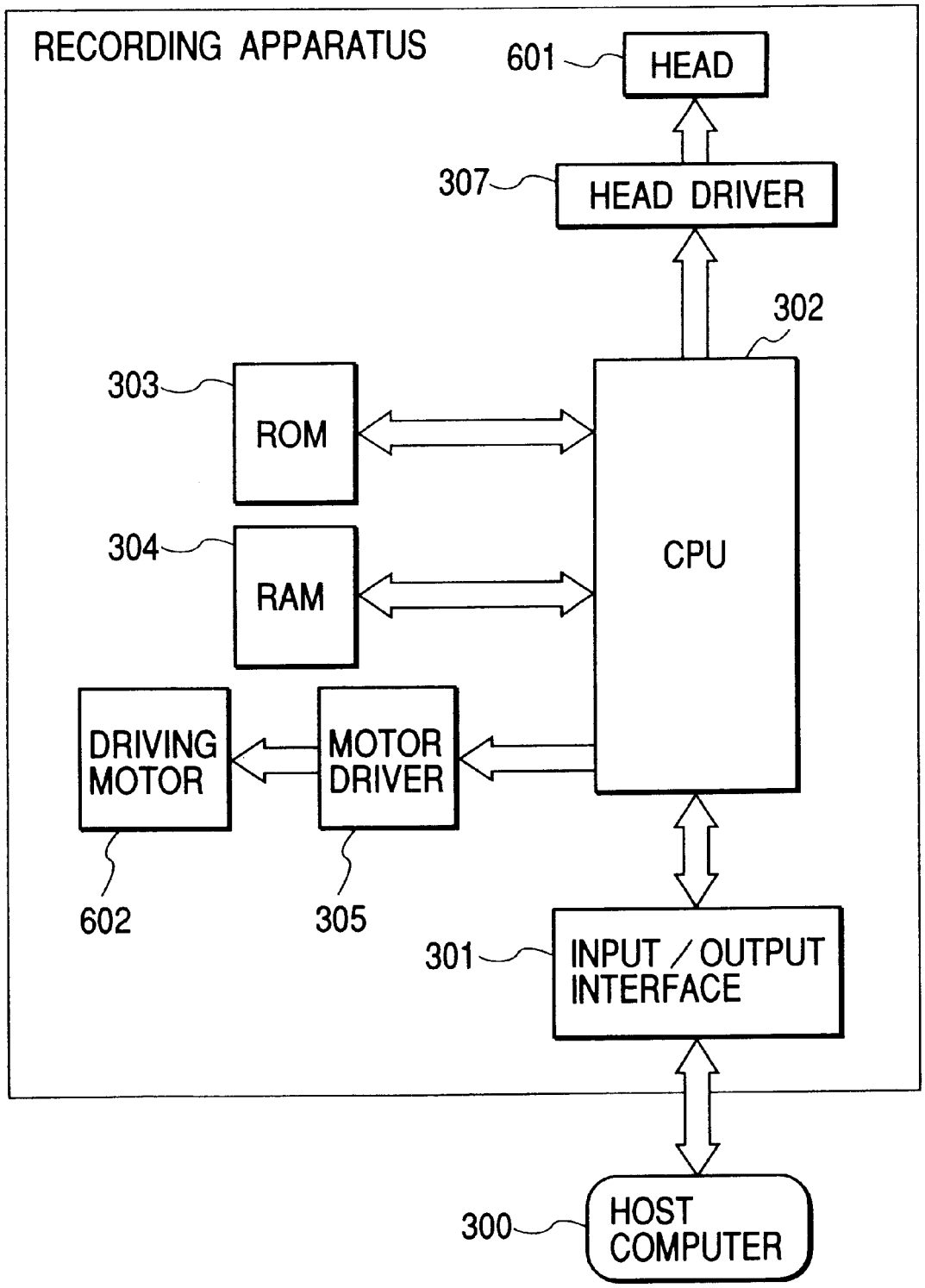
FIG. 13 shows the block diagram of the total system for recording with the discharged liquid by the liquid discharging method and liquid discharging head of the present invention.

FIG. 13 shows the block diagram of the total system for ink-jet recording by the liquid discharging head of the present invention.

The recording device receives printed information as the control signal from the host computer 300. The printed information is temporarily stored in the input interface 301 in the printing device, and, at the same time, converted into the processable data in the recording device and inputted in the CPU (central processing unit) 302 which also works as the means for supplying the head driving signals. The CPU 302 processes the data inputted therein, based on the control program stored in the ROM (lead only memory) 303, using the peripheral units, e.g., RAM (random access memory) 304, and converted them into the data (image data) to be printed. The CPU 302 also produces the driving data for driving the driving motor 602, which moves, synchronously with the image data, the carriage 607 carrying the recording paper and head cartridge 601, in order to record the image data in an adequate position on the recording paper. The image data and motor driving data are transmitted to the respective head cartridge 601 and driving motor 602 via the head driver 307 and motor driver 305, and timed to produce the images in a controlled manner.

Various types of the recording media 150 may be used to produce the images thereon with the liquid, e.g., ink, by the above recording device. They include various types of paper and OHP sheets, plastics used for compact disks and decorative plates, cloth, metallic materials (e.g., aluminum and copper), natural and artificial leather goods (e.g., cowhide and pigskin), lumbers including plywood, bamboo, ceramics (e.g., tiles), and three-dimensional structures (e.g., sponges).

The recording device can include various types of printers, for printing or dyeing images, e.g., on various types of paper and OHP sheets, plastics (e.g., compact disks), metallic materials (e.g., metallic plates), leather products, lumbers, ceramics, three-dimensional structures (e.g., sponges), textiles (e.g., cloth).

The liquid to be discharged from the liquid discharging apparatus can be selected from those suitable for specific recording media and recording conditions.

What is claimed is:

1. A liquid discharging head, comprising:

a discharge port for discharging liquid;

a liquid passage provided with bubble-generating means for generating a bubble in the liquid supplied via a liquid supply port, said liquid passage communicating with said discharge port at one end of said liquid passage; and a movable member arranged apart from said discharge port by a gap in said liquid passage corresponding to said bubble-generating means, wherein a projected area of said movable member on said liquid supply port is larger than an opening area of said liquid supply port, said bubble-generating means is arranged on a wall facing a wall to which said liquid supply port in said liquid passage is open, said movable member comprises a fulcrum at one end of said liquid passage and a free end on a closed side of said liquid passage, said bubble-generating means is arranged to face said free end, and said liquid supply port is open to said liquid passage on a side of said fulcrum, and said discharge port is positioned on the side of said fulcrum.

2. A liquid discharging apparatus, comprising the liquid discharging head according to claim 1, and transferring means for transferring a recording medium which receives the liquid discharged by said liquid discharging head.

3. The liquid discharging apparatus according to claim 2, which records an image on said recording medium with the liquid discharged by said liquid discharging head.

4. A liquid discharging head, comprising:

a discharge port for discharging liquid;

a liquid passage provided with a bubble-generating means for generating a bubble in the liquid supplied via a liquid supply port, said liquid passage communicating with said discharge port at one end of said liquid passage; and a movable member arranged apart from said discharge port by a gap in said liquid passage for said bubble-generating means, wherein a projected area of said movable member on said liquid supply port is larger than an opening area of said liquid supply port, said movable member is supported by a fulcrum thereof on a side where the bubble generated by said bubble-generating means greatly grows, and has a free end on a side where growth of the bubble is controlled, said liquid supply port is open to said liquid passage on a side of said fulcrum, said movable member substantially closes said liquid supply port as the bubble is generated by said bubble-generating means, to discharge the liquid from said discharge port by directing a pressure wave produced by the bubble in a concentrated manner towards said discharge port, said discharge port being positioned on the side of said fulcrum, and said free end is displaced towards said bubble-generating means as the bubble disappears, and said liquid supply port, which is positioned on the side of said fulcrum, comes into a state of communication with said liquid passage, to supply the liquid to said liquid passage.

5. A liquid discharging apparatus, comprising the liquid discharging head according to claim 4, and transferring means for transferring a recording medium which receives the liquid discharged by said liquid discharging head.

6. The liquid discharging apparatus according to claim 4, which records an image on the recording medium with the liquid discharged by said liquid discharging head.

7. A liquid discharging head, comprising:

a discharge port for discharging liquid;

a bubble-generating means for generating a bubble in the liquid;

a liquid passage whose one end is in communication with said discharge port and whose other end is closed;

a liquid supply port provided to said liquid passage, for supplying the liquid to said liquid passage; and a movable member provided in said liquid passage in such a way as to face said bubble-generating means on a side of said discharge port and to face said liquid supply port on another side with a gap between said movable member and said liquid supply port, wherein a projected area of said movable member on said liquid supply port is larger than an opening area of said liquid supply port.

8. The liquid discharging head according to claim 7, wherein said movable member is supported by a fulcrum thereof on a discharge port side of said liquid passage, and said movable member has a free end on a closed end side of said liquid passage, said bubble-generating means is arranged to face said free end, and said liquid supply port is open to said liquid passage on a side of said fulcrum.

9. A liquid discharging apparatus, comprising the liquid discharging head according to claim 7, and transferring means for transferring a recording medium which receives the liquid discharged by said liquid discharging head.

10. The liquid discharging apparatus according to claim 9, which records an image on the recording medium with the liquid discharged by said liquid discharging head.

11. A liquid discharging head, comprising:

a discharge port for discharging liquid;

a bubble-generating means for generating a bubble in the liquid;

a liquid passage whose one end is in communication with said discharge port and whose other end is closed;

a liquid supply port provided to said liquid passage, for supplying the liquid to said liquid passage; and a movable member provided in said liquid passage in such a way as to be supported on a liquid supply port side while keeping a gap from said liquid supply port in said liquid passage, wherein said movable member is supported by a fulcrum thereof on a discharge port side of said liquid passage, and said movable member has a free end on a closed end side of said liquid passage, a projected area of said movable member on said liquid supply port is larger than an opening area of said liquid supply port, said movable member substantially closes said liquid supply port as the bubble is generated by said bubble-generating means, to discharge the liquid from said discharge port by controlling growth of the bubble towards the closed end while greatly promoting growth of the bubble towards said discharge port, and said free end is displaced towards said bubble-generating means as the bubble disappears, and said liquid supply port, which is positioned on a side of said fulcrum, comes into a state of communication with said liquid passage, to supply the liquid to said liquid passage.

12. A liquid discharging apparatus, comprising the liquid discharging head according to claim 11, and transferring means for transferring a recording medium which receives the liquid discharged by said liquid discharging head.

13. The liquid discharging apparatus according to claim 12, which records an image on the recording medium with the liquid discharged by said liquid discharging head.

14. A liquid discharging method of a liquid discharging head, the liquid discharging head comprising a discharge port for discharging liquid, a bubble-generating means for generating a bubble in the liquid, a liquid passage whose one end is in communication with the discharge port and whose other end is closed, a liquid supply port provided to the liquid passage on a side of the liquid passage opposite a closed end side, for supplying the liquid to the liquid passage, and a movable member provided in the liquid passage comprising a fulcrum on the side opposite the closed end side and a free end on the closed end side, the movable member being supported by the fulcrum while keeping a gap from the liquid supply port in the liquid passage, wherein a projected area of the movable member on the liquid supply port is larger than an opening area of the liquid supply port, said method comprising the steps of:

discharging the liquid from the discharge port by generating the bubble by said bubble-generating means to substantially close the discharge port thereby to control growth of the bubble towards the closed end while greatly promoting growth of the bubble towards the discharge port; and supplying the liquid to the liquid passage by displacing the free end towards the bubble-generating means as the bubble disappears, to cause flow of the liquid via the liquid supply port from a fulcrum side to a free end side of the movable member on a liquid supply port side of the movable member, and also from the free end side to the fulcrum side of the movable member on a bubble-generating means side of the movable member.

15. A method for producing a liquid discharging head comprising a discharge port for discharging liquid, a bubble-generating means for generating a bubble in the liquid supplied via a liquid supply port, a liquid passage in communication with the discharge port, and a movable member arranged apart from the discharge port by a gap in the liquid passage for the bubble-generating means, wherein a projected area of the movable member on the liquid supply port is larger than an opening area of the liquid supply port, said method comprising the steps of:

forming a first gap-forming member for forming a gap on a first base plate between the liquid supply port and the movable member;

forming a film of a material which will serve as the material for the movable member, which covers the first base plate and the first gap-forming member;

patterning the film into a cantilever shape with one end as a fulcrum on a liquid passage side and another end as a free end;

forming a second gap-forming member on the film forming a part of the liquid passage;

forming a wall member as a side wall of the liquid passage on the film and the second gap-forming member;

flattening the second gap-forming member and the side wall in such a way that the second gap-forming member and the side wall form one plane;

forming a second base plate containing the bubble-generating means on the flattened second gap-forming member and the side wall;

forming the discharge port in a section corresponding to the second gap-forming member on one end of the liquid passage; and opening the first base plate to form the liquid supply port having a smaller opening area than a projected area of the movable member and removing the first gap-forming member, and removing the second gap-forming member via the liquid supply and discharge ports.

16. The method for producing a liquid discharging head according to claim 15, wherein said step for forming the second base plate includes forming a heat-generating resistance layer and electrical wiring circuits for supplying electrical energy to the heat-generating resistance layer.

17. The method for producing a liquid discharging head according to claim 15, wherein said step for opening the first base plate and removing the first gap-forming member comprises a step of opening the liquid supply port in the first base plate in a portion corresponding to the one end of the liquid passage.

* * * * *

UNITED STATES PATENT AND TRADEMARK OFFICE

CERTIFICATE OF CORRECTION

PATENT NO. : 6,464,345 B2
DATED : October 15, 2002
INVENTOR(S) : Masahiko Kubota et al.

It is certified that error appears in the above-identified patent and that said Letters Patent is hereby corrected as shown below:

Title page,
Item [56], References Cited, FOREIGN PATENT DOCUMENTS,
"JP 63-28654 2/1998" should read -- JP 63-28654 2/1988 --.

Column 1,
Line 9, "acting" should read -- activating --;
Line 22, "meaning" should read -- meaningful --; and
Line 29, "bubbles, rapid" should read -- bubbles, the result of which is a rapid volumetric change, used to discharge --.

Column 2,
Line 1, "off them" should read -- them off --; and "second" should read -- a second --;
Line 3, "off them" should read -- them off --;
Line 21, "closely" should read -- close --;
Line 37, "of near" should read -- near --;
Lines 41 and 43, "disappear" should read -- disappearance --;
Line 42, "loss of" should be deleted; and
Line 58, "other;" should read -- other: --.

Column 3,
Line 38, "produces" should read -- produce --;
Line 44, "little" should be deleted; and
Line 45, "increases" should read -- increases little --.

Column 7,
Lines 60 and 62, "way" should read -- way as --.

Column 8,
Line 33, "closely" should read -- close --;
Line 46, "infinitive" should read -- indefinite --;
Line 58, "greatly" should read -- considerably --; and
Line 60, "whereas" should read -- whereas they --.

Column 9,
Line 28, "little grow." should read -- grow little. --;
Line 29, "where" should read -- whereas --;
Line 30, "greatly" should read -- considerably --;
Line 38, "making" should read -- putting --; and
Line 42, "disappears" should read -- disappearing --.

UNITED STATES PATENT AND TRADEMARK OFFICE

CERTIFICATE OF CORRECTION

PATENT NO. : 6,464,345 B2
DATED : October 15, 2002
INVENTOR(S) : Masahiko Kubota et al.

It is certified that error appears in the above-identified patent and that said Letters Patent is hereby corrected as shown below:

Column 10,
Line 40, "left" should read -- is left --.

Column 11,
Line 7, "hi" should read -- h1 --;
Line 36, "back" should be deleted;
Line 38, "improve" should read -- improving --;
Line 47, "making" should read -- making it difficult for --;
Line 47, "difficult" should be deleted; and
Line 51, "viscous" should read -- viscous so as --.

Column 16,
Line 43, "(lead" should read -- (read --; and
Line 45, "converted" should read -- converts --.

Signed and Sealed this

Eighteenth Day of April, 2006

JON W. DUDAS
*Director of the United States Patent and Trademark Office*